US009620051B2

(12) United States Patent
Shi et al.

(10) Patent No.: US 9,620,051 B2
(45) Date of Patent: Apr. 11, 2017

(54) DISPLAY BRIDGE WITH SUPPORT FOR MULTIPLE DISPLAY INTERFACES

(71) Applicant: Amlogic Co., Ltd., Santa Clara, CA (US)

(72) Inventors: Chao Shi, San Jose, CA (US); Chieh-Yuan Chao, Fremont, CA (US); Jinguo He, Shanghai (CN); Xiang OuYang, Shanghai (CN)

(73) Assignee: Amlogic Co., Limited, Santa Clara, CA (US)

( * ) Notice: Subject to any disclaimer, the term of this patent is extended or adjusted under 35 U.S.C. 154(b) by 372 days.

(21) Appl. No.: 14/273,930

(22) Filed: May 9, 2014

(65) Prior Publication Data

US 2015/0097821 A1 Apr. 9, 2015

Related U.S. Application Data

(60) Provisional application No. 61/887,232, filed on Oct. 4, 2013.

(51) Int. Cl.
*G09G 5/14* (2006.01)
*G09G 3/20* (2006.01)

(52) U.S. Cl.
CPC ..... *G09G 3/2096* (2013.01); *G09G 2370/14* (2013.01)

(58) Field of Classification Search
CPC ..... G09G 5/14; G09G 5/363; G09G 2370/14; G09G 3/2096
See application file for complete search history.

(56) References Cited

U.S. PATENT DOCUMENTS

2004/0150650 A1* 8/2004 Mendelson ..... G09G 5/005 345/589

* cited by examiner

*Primary Examiner* — Amare Mengistu
*Assistant Examiner* — Shawna Stepp Jones
(74) *Attorney, Agent, or Firm* — Venture Pacific Law, PC

(57) ABSTRACT

Method and apparatus for a display bridge with support for multiple display interfaces are disclosed. The novel display bridge comprises a predriver configured to provide data input signals. A shared output driver is configured to receive the data input signals and provide output display signals compatible for driving MIPI-DSI, EDP, or LVDS displays. A regulator and current source is coupled to the shared output driver configured to regulate the shared output driver operating voltage and provide a current source for the shared output driver. A shared termination output coupled to the shared output driver is configured to provide termination resistance for the output display signals and termination voltage for the termination resistance.

18 Claims, 5 Drawing Sheets

DISPLAY BRIDGE WITH SUPPORT FOR MULTIPLE DISPLAY INTERFACES

CROSS REFERENCE

This application claims priority from a provisional patent application entitled "A Display Bridge with Support for Multiple Display Interfaces" filed on Oct. 4, 2013 and having an Application No. 61/887,232. Said application is incorporated herein by reference.

FIELD OF INVENTION

This invention relates to a display bridge, and, in particular, to a display bridge with support for multiple output display formats.

BACKGROUND

With the recent popularity in the use of flat panel displays, a number of competing electrical digital signaling standards dominates the digital display industry. Low-voltage differential signaling, or LVDS, is an electrical digital signaling standard that can run at very high speeds over inexpensive twisted-pair copper cables. LVDS has been popular and is used in products like LCD-TVs, automotive instrument displays, industrial camera and machine vision products, notebook displays and tablet displays for computers.

Embedded Display Port (EDP) is another display standard with a goal to define a standardized display panel interface for internal (embedded) connections between for example graphics cards and notebook display panels. Compared to LVDS, the highest data rate found in LVDS interfaces between an image processing IC and a timing controller IC is about 1.05 Gbit/s, per-pair. On the other hand, EDP achieves 2.7 Gbit/s or almost three fold increase in speed and data throughput.

Another digital display signaling standard is the Display Serial Interface (DSI), a specification introduced by the Mobile Industry Processor Interface (MIPI) Alliance with a goal at reducing the cost of display sub-systems in a mobile device. The DSI defines a serial bus and a communication protocol between the host (source of the image data) and the device (destination of the image data). DSI specifies a high-speed differential signaling point-to-point serial bus.

Since all three digital signaling standards are directed to LCDs and with the current explosion in the use of hand held devices using LCDs, there is a need to have a single digital display bridge device that can be used with any of the three dominate digital display standards.

SUMMARY OF INVENTION

Method and apparatus for a display bridge with support for multiple display interfaces are disclosed. The novel display bridge comprises a predriver configured to provide data input signals. A shared output driver is configured to receive the data input signals and provide output display signals compatible for driving either MIPI-DSI, EDP, or LVDS displays. A regulator and current source is coupled to the shared output driver configured to regulate the shared output driver operating voltage and provide a current source for the shared output driver. A shared termination output coupled to the shared output driver is configured to provide termination resistance for the output display signals and termination voltage for the termination resistance.

In accordance to another aspect of the present invention, the shared output driver is configured to receive the data input signals and provide output display signals compatible for driving a MIPI-DSI display and includes the predriver configured to provide a differential signal to the shared output driver. The regulator and current source is configured to set an operating voltage of approximately 400 mv for the shared output driver. The shared termination is configured to be in high impedance state. The output driver is configured to receive the differential signal and alternate drive the output display signals based on the differential signal.

In accordance to another aspect of the present invention, the shared output driver is configured to receive the data input signals and provide output display signals compatible for driving a EDP display and includes the predriver configured to provide a data in differential signal and a data in preemphasis signal. The shared output driver is configured to receive the data in differential signal and the data in preemphasis signal and provide positive output signals and negative output signals for driving an EDP display. The regulator and current source provides a first current source for the data in differential signal and a second current source for the data in preemphasis differential signal. The shared termination output is configured to set a termination voltage and a termination resistance for the positive output signals and the negative output signals.

DESCRIPTION OF THE DRAWINGS

The foregoing and other objects, aspects, and advantages of the invention will be better understood from the following detailed description of the preferred embodiment of the invention when taken in conjunction with the accompanying drawings in which.

DETAILED DESCRIPTION OF THE PREFERRED EMBODIMENTS

The present invention provides a display bridge with support for multiple display interfaces. The display bridge supports three common standards comprising embedded display port (EDP), Mobile Industry Processor Interface (MIPI) Alliance for Display Serial Interface (DSI), and Low-voltage differential signaling (LVDS). The advantages of the display bridge with support for multiple display interfaces include smaller die, reduced pin out for the combination, speed and flexibility of a single bridge for multiple display interface support. Each display interface has particular physical layer devices (PHY) to support the particular display standard. In this particular case, three PHYs are required for LVDS, MIPI-DSI and EDP. Accordingly, the present display bridge supports at least the three different PHYs. For example, LVDS typically has a common mode voltage of 1.25 v with a positive and negative output swing of +/−300 mv. On the other hand, MIPI-DSI has a common mode voltage of approximately 200 mv with a voltage output swing of +/−200 mv. The reduction in common mode voltage greatly reduces electromagnetic interference (EMI). With EDP, common mode voltage is not used and voltage swing can be from 500 mv to 1.0 v.

Figure 1:
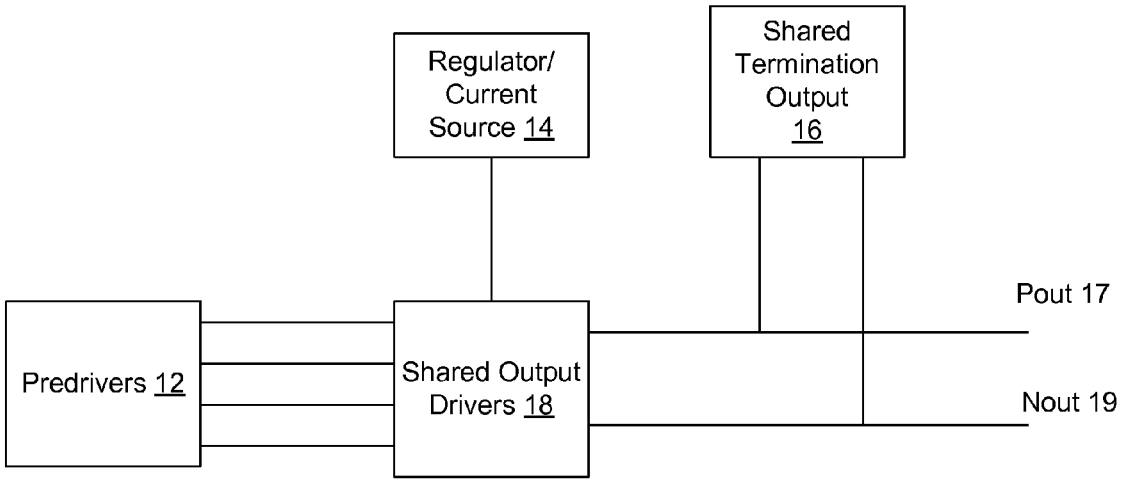
FIG. 1 illustrates a block diagram of a display bridge with support for multiple output display formats in accordance to an embodiment of the present invention.

FIG. 1 illustrates a block diagram of a display bridge with support for multiple output display formats in accordance to an embodiment of the present invention. Predrivers 12 provide data signal input to the shared output drivers 18. Predrivers 12 include a level shifter to shift the data input signal as needed depending on the particular output display format. Similarly, regulator and current source 14 provides voltage adjustment and current source for the shared output drivers 18. The shared output drivers 18 provide output for positive output signal Pout 17 and negative output signal Nout 19 for driving a display device in accordance to a particular display format PHY. Depending on the particular output display format, a shared termination output 16 provides signal termination for the differential output signal, as needed. Those skilled in the art will readily appreciate that there may be many lanes or channels and that FIG. 1 represents a single lane or channel.

Figure 2:
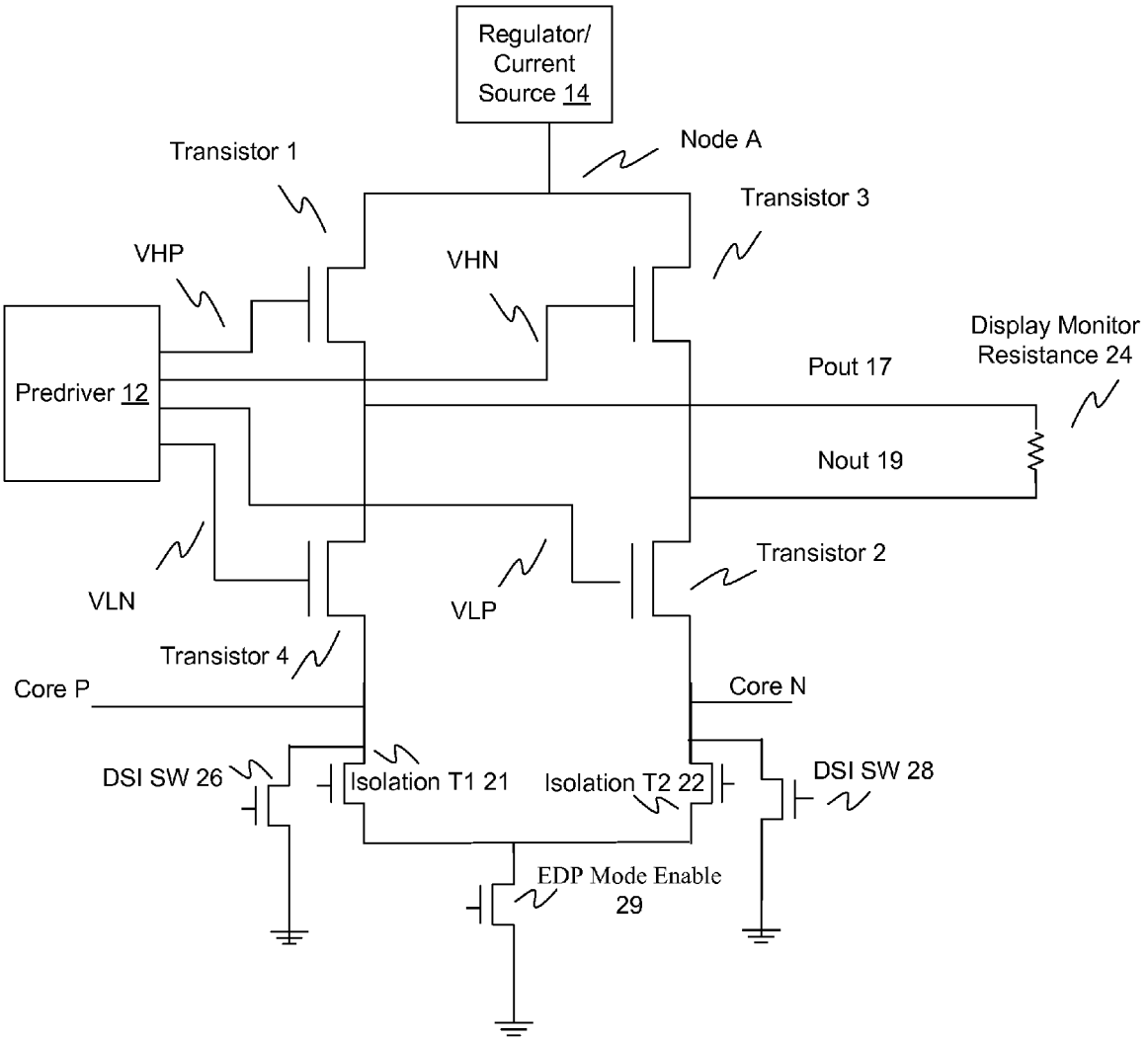
FIG. 2 illustrates a block diagram of the display bridge with support for MIPI-DSI mode in accordance with an embodiment of the present invention.

FIG. 2 illustrates a block diagram of the display bridge with support for MIPI-DSI mode. Predriver 12 provides differential pairs voltage high positive signal (VHP) and voltage low positive signal (VLP) to the gate of transistor 1 and gate of transistor 2, respectively. Predriver 12 also provides differential pairs voltage high negative signal (VHN) and voltage low negative (VLN) to the gate of transistor 3 and gate of transistor 4, respectively. In accordance to an embodiment of the present invention, the predriver 12 sets the VHP signal to the gate of transistor 1 to be approximately 200 mv higher than the VLP signal to the gate of transistor 2. Stated differently, Vgs of transistor 1 is approximately equal to Vgs of transistor 2 plus 200 mv. Similarly, since the VHN signal and the VLN signal are negative components of the differential VHP signal and VLP signal, the predriver 12 also provides differential pairs voltage high negative signal (VHN) and voltage low negative signal (VLN) to the gate of transistor 3 and to the gate of transistor 4, respectively. The regulator and current source 14 provides a node A output voltage of approximately 400 mv for the operating voltage of the shared output driver 18. As the Predriver 12 provides the differential signals VHP, VHN and VLP, and provides VLN to the shared output driver 18 consisting at least transistor 1, transistor 2, transistor 3 and transistor 4, positive output signal (Pout) 17 and negative output signal (Nout) 19 drive the monitor resistance 24 which depicts an external monitor, such as a LCD. Since the MIPI-DSI mode provides a differential signal, the output of predriver 12 alternatively turns on transistor pairs 1 and 3 and transistor pairs 2 and 4. Moreover, when transistor pairs 1 and 3 are on, transistor pairs 2 and 4 are off. Typically, the display monitor has a monitor resistance 24 that is set to approximately 100 ohms. Accordingly, predriver 12 alternately turns on pairs 1 and 3 and transistor pairs 2 and 4 and completes the signal path to ground via DSI switch 26 and DSI switch 28. In accordance to an embodiment of the present invention, the DSI switch 26 and DSI switch 28 are core transistors as opposed to I/O transistors. The advantage of the core transistor is the relatively low impedance of the core device when it is turned on. In accordance to an embodiment of the present invention, the DSI switch 26 and DSI switch 28 each has a turn on impedance of less than 3 ohms. During DSI mode, transistor Isolation T1 21 and transistor Isolation T2 22 are turned off. When transistor Isolation T1 21 and transistor Isolation T2 22 are turned off, there is no current sink through Isolation T1 21 and Isolation T2 22. Accordingly, EDP Mode Enable 29 is turned off. EDP Mode Enable 29 is a current source that will be active when the display bridge is in EDP mode.

In order to provide MIPI-DSI compatibility and reduce signal reflection of the differential signal Pout 17 and Nout 19, a characteristic impedance of 50 ohms is achieved for Pout 17 and Nout 19. To achieve the characteristic impedance, the resistance for the turn on voltage of transistor 1 and transistor 2 is set to be approximately 50 ohms. Since, resistance on (Ron) is approximately equal to $L/u_n c_{OX} W(Vgs-Vt)$ or $R_{ON}=L/u_n c_{OX} W(Vgs-Vt)$, where $u_n$ is electron mobility, $c_{OX}$ is oxide capacitance, L is length, W is width, and Vt is threshold voltage.

Based on the Ron equation, setting L, W, and Vt essentially equal for all transistors, and Vgs essentially the same value, Ron will be in the range of 50 ohms. It has been shown that ignoring Vt's body effect, the gate voltage for transistor 1 and transistor 3 will be approximately 200 mV higher than the gate voltage of transistor 2 and transistor 4 in order to achieve approximately equal Vgs. The predriver 12 level shifts the voltage to achieve a turn on Vgs for transistor 1 with an Ron of approximately 50 ohms. Similarly, the predriver 12 level shifts the voltage to achieve a turn on Vgs for transistor 2 with a Ron of approximately 50 ohms. Since the DSI switches 26 and 28 have a turn on voltage of about 5 ohms while transistor Isolation T1 21 and transistor Isolation T2 22 are turned off during DSI mode, compared with the Ron of 50 ohms for transistor 2, the 5 ohms of the DSI switches 26 and 28 can be ignored in most cases.

Accordingly an equivalent circuit for the display bridge with support for MIPI-DSI mode can be modeled as 400 mv power source in series with 50 ohms (transistor 1) in series with 100 ohms (typical display monitor resistance) in series with 50 ohms (transistor 2) in series with 5 ohms (DSI Switches 26, 28). Based on the equivalent circuit, the output at display monitor resistance 24 in MIPI-DSI mode has a common mode voltage of approximately 200 mv with a voltage output swing of +/−200 mv. Moreover, since transistor 1 and transistor 2 are set to have a characteristic impedance of approximately 50 ohms, the shared termination output 16 in MIPI-DSI mode is not used and is set to high impedance. The shared termination output 16 is not shown in FIG. 2 so as not to unduly obscure the description of the DSI mode. It should be noted that EDP Mode Enable 29 of FIG. 2 is depicted as Imain 32 in FIG. 3 since EDP Mode Enable 29 functions as a current sink. During DSI mode, EDP Mode Enable 29 or Imain 32 is turned off. EDP Mode Enable 29 is turned on during EDP mode and is described with reference to FIGS. 3-4. It should be noted that the MIPI-DSI mode may include low power single end driver, which connects with differential output node Pout 17 and Nout 19 for additional flexibility.

Figure 3:
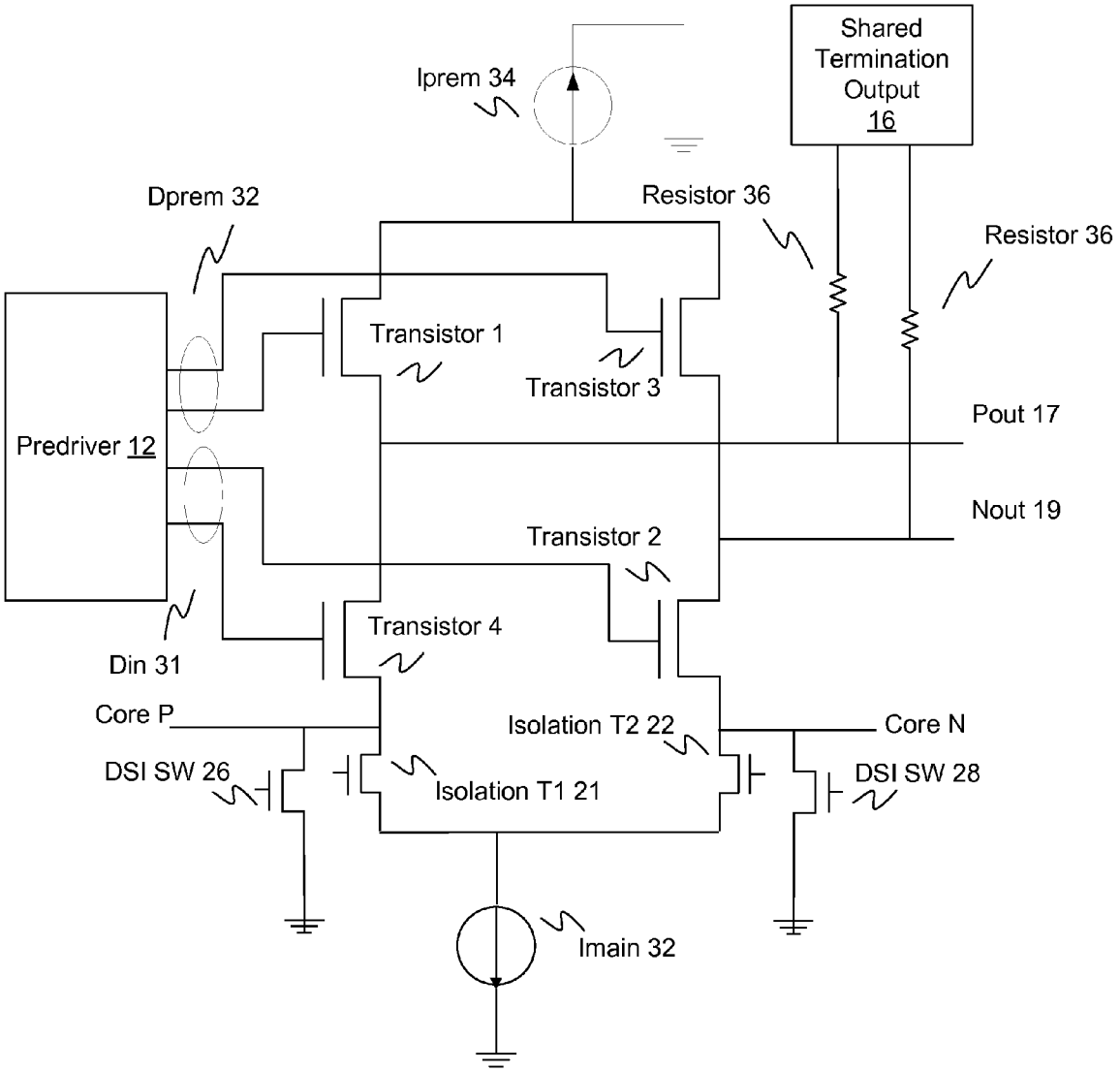
FIG. 3 illustrates a block diagram of the display bridge with support for Embedded Display Port (EDP) I/O device mode in accordance with an embodiment of the present invention.

FIG. 3 illustrates a block diagram of the display bridge with support for Embedded Display Port (EDP) I/O device mode in accordance to an embodiment of the present invention. Predriver 12 provides differential display signal Din 31 that is applied to transistor 4 and transistor 2 of the shared output driver 18. Differential display signal preemphasis Dprem 32 is applied to transistor 1 and transistor 3 of the shared output driver 18 which consists of at least transistor 1, transistor 2, transistor 3, and transistor 4. The preemphasis signal Dprem 32 is derived from the display signal Din 31 and is the display signal Din 31 delayed by one clock cycle and inverted. The preemphasis signal Dprem 32 adjusts the Din 31 signal with some distortion so the output signal of the eye diagram will be within the desired eye opening, also known as the preemphasis effect. Generally, preemphasis boosts only the high frequency components of the signal, while leaving the low frequency components in their original state. Preemphasis operates by boosting the high frequency energy every time a transition in the data occurs in order to improve the overall signal-to-noise ratio.

In accordance to an embodiment of the present invention, the preemphasis signal may be adjusted by reducing current Iprem 34 to 20 percent, 30 percent, or 50 percent of current Imain 32 from Iprem 34. The shared termination output 16 is configured with resistors 36 having a characteristic impedance of 50 ohms. Accordingly, positive output Pout 17 is coupled to resistor 36 and negative output Nout 19 is coupled to another resistor 36. The shared termination output 16 can be set to approximately 1.8 v for EDP. During EDP I/O device mode, DSI SW 26 and DSI SW 28 are turned off. Isolation T1 21 and T2 22 are turned on to ensure Imain 32 sinks current. Recall Imain 32 is EDP Mode Enable 29 of FIG. 2. The EDP Mode Enable 29 is activated in EDP mode to sink current and is shown as Imain 32 in FIG. 3. During EDP I/O device mode, I/O differential device pair transistor 1 and transistor 3 act as pre-emphasis switch devices and I/O differential device pair transistor 2 and transistor 4 act as main switch devices which differs from the operation in DSI mode. Connection points at Core P and Core N are not active and are not used during EDP I/O mode.

Figure 4:
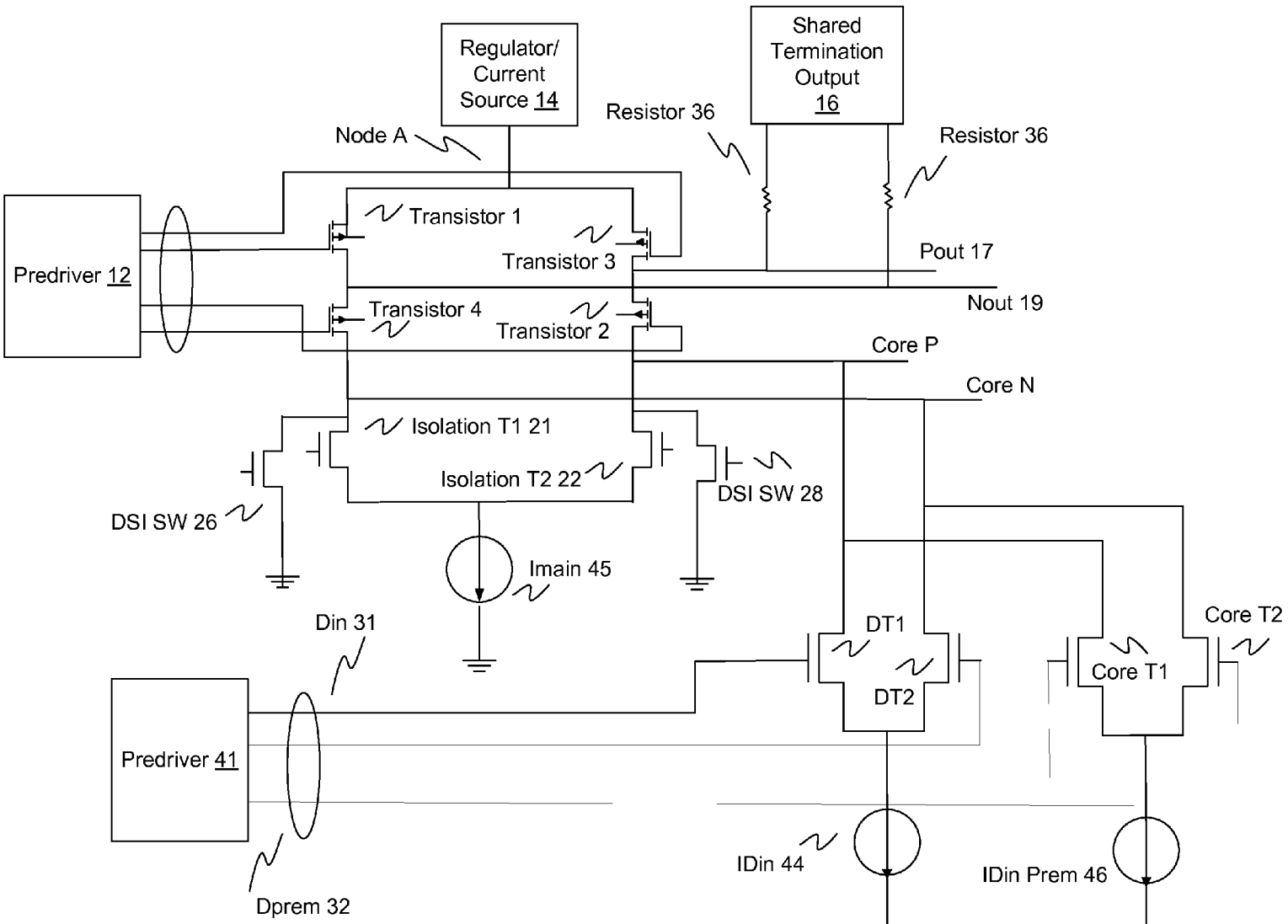
FIG. 4 illustrates an alternative embodiment of the display bridge with support for embedded display port (EDP) mode with core transistors mode in accordance with an embodiment of the present invention.

FIG. 4 illustrates an alternative embodiment for the display bridge in EDP mode with core transistors mode in accordance with the present invention. EDP mode with core transistors for the data in signal Din 31 and the EDP mode for the data in preemphasis signal Dprem 32 share outputs Pout 17 and Nout 19 similar to EDP mode for I/O device mode of FIG. 3. Digital transistor 1 (DT1) and digital transistor 2 (DT2) are main driver switch devices. IDin 44 supplies current to the main driver switch devices DT1 and DT2 and defines a main current value, which depending on signal swing can be in the range of 12 mA and is controlled by system design preference. Core transistor T1 (Core T1) and Core transistor T2 (Core T2) are pre-emphasis driver switch devices. IDin Prem 46 supplies current to the pre-emphasis switch devices Core T1 and Core T2 and defines a pre-emphasis current value which depending on system requirements can be approximately 20% of IDin 44. In accordance to a present embodiment, the main driver current can be in the range of 10 mA to 15 mA. DT1 and DT2, and Core T1 and Core T2 are driven by Predriver 41. In operation during EDP mode with core transistors mode, connection points Core P and Core N become active and is used. Isolation T1 21 and Isolation T2 22 are turned off, and DSI SW 26 and DSI SW 28 are similarly turned off. Transistor 1 and transistor 3 are turned off by Predriver 12. Transistor 4 and transistor 2 become isolation devices instead of being switch devices under EDP I/O device mode. Predriver 12 supplies a constant voltage bias of approximately 1.5 v to transistor 4 and transistor 2. Accounting for Vgs drop of transistor 4 and transistor 2, node Core N and node Core P prevent DT2, DT1, Core T1, and Core T2 to enter into stress mode, respectively, since DT1, DT2, Core T1, and Core T2 are core devices. The shared termination output 16 provides termination resistor for tune and adjustment. In EDP mode with core transistors mode embodiment, the core device transistors DT1, DT2, Core T1 and Core T2 are added in addition to the I/O transistors transistor 1, transistor 2, transistor 3, and transistor 4 of the shared output driver 18. Core device transistors are 0.9 v transistors as opposed to I/O transistors which are 1.8 v. Core device transistors switch much faster than I/O transistors. I/O devices typically have a length of 270 nm while core devices have a length of approximately 30 nm. The regulator and current source 14 provides a node A voltage of approximately 0.9 v. Predriver 12 turns off transistor 1 and transistor 3 and configures Core N of transistor 4 and Core P of transistor 2 to be approximately 1.5 v to accommodate the core device transistors, which act as source followers to reduce stress to the core devices. DT1 and DT2 are coupled to predriver 41. Core T1 and Core T2 are similarly coupled to predriver 41. Accordingly, DT1, DT2, Core T1, and Core T2 are 0.9 v transistors. Current source IDin 44 is coupled to DT1 and DT2. DT1 and DT2 do not need to swing rail to rail from 0 v to 0.9 v during operation. Similarly, current source ID Prem 46 is coupled to Core T1 and Core T2. Core T1 and Core T2 do not need to swing rail to rail from 0 v to 0.9 v during operation. It has been shown that 0.4 v is sufficient to turn off DT1, DT2, Core T1, and Core T2 that results in even faster switching. Typically, core transistors do not need to be driven any more than 0.9 v to avoid undue stress to the device which may cause premature failures. DT1 and Core T1 are coupled to node Core P, and DT2 and Core T2 are coupled to node Core N. Similar to the non-core transistor embodiment of FIG. 3, termination resistors 36 are coupled to the shared termination output 16 Pout 17 and Nout 19.

The core transistor embodiment reduces the voltage requirement for operating in EDP mode. Because the core transistors switch much faster than I/O transistors, the core transistor embodiment affords faster switching and lower noise since the operating voltage is lower than the I/O transistor embodiment shown in FIG. 3. The core device transistor embodiment provides better performance at reduced die size and lower power consumption.

Figure 5:
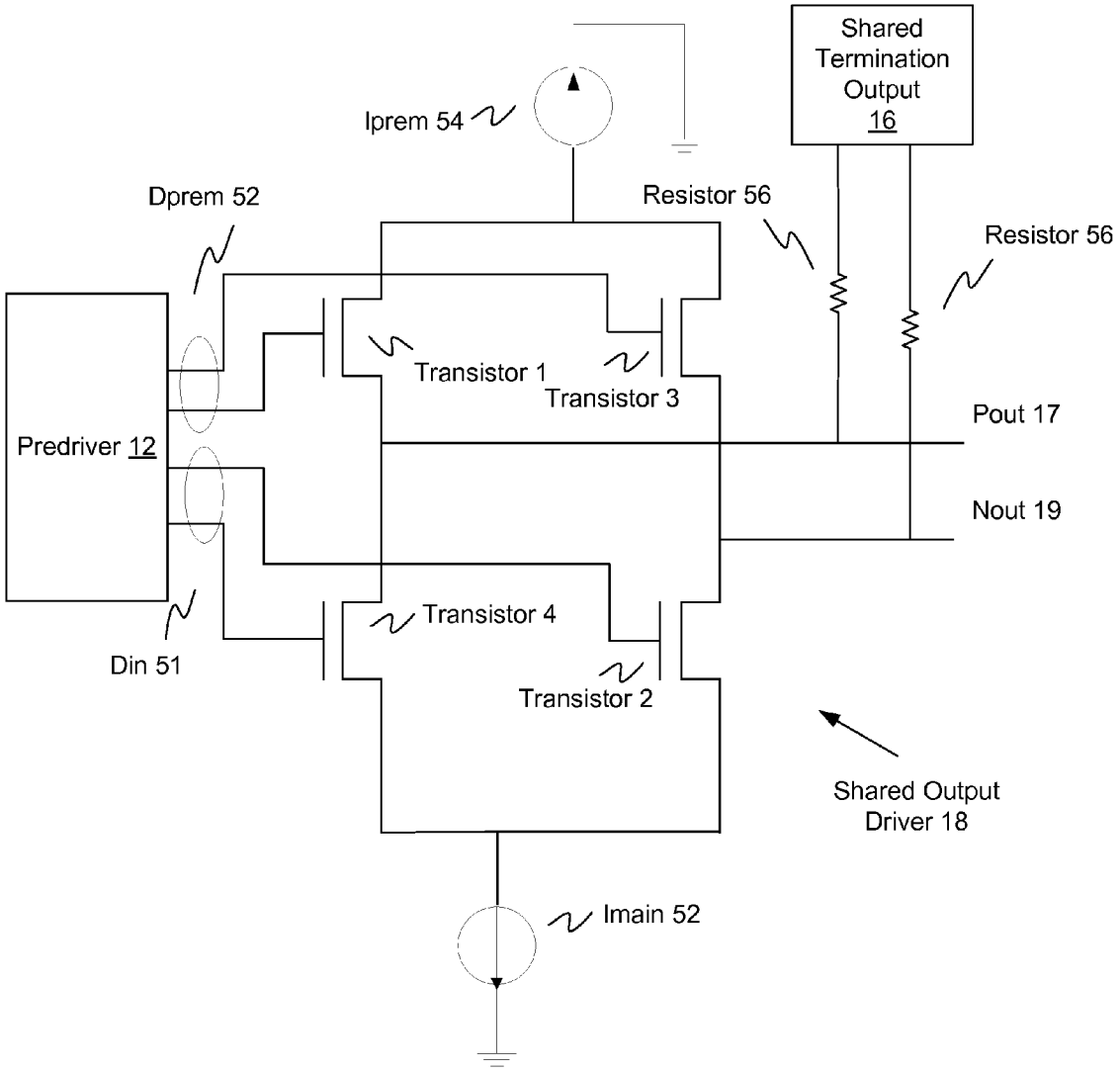
FIG. 5 illustrates a block diagram of the display bridge with support for LVDS in accordance with an embodiment of the present invention.

FIG. 5 illustrates a block diagram for the display bridge with support for LVDS mode in accordance with an embodiment of the present invention. LVDS is similar to EDP except LVDS is slower and operates at a lower frequency than EDP. Predriver 12 provides a differential display signal Din 51 that is applied to transistor 4 and transistor 2 of the shared output driver 18. Similarly, predriver 12 provides a differential display preemphasis Dprem 52 that is applied to transistor 1 and transistor 3 of the shared output driver 18. As similar to the EDP mode, the preemphasis signal Dprem 52 is derived from the display signal Din 51 and is the display signal Din 51 delayed by one clock cycle and inverted. The preemphasis signal adjusts the Din 51 signal with some distortion to compensate the output signal so that the resulting eye diagram will be within the desired eye opening also known as the preemphasis effect.

The shared termination output 16 is configured with resistors 56 having a characteristic impedance of 50 ohms. Accordingly, positive output Pout 17 is coupled to resistor 56 and negative output Nout 19 is coupled to another resistor 56. In accordance to an embodiment of the present invention, the shared termination output 16 can vary termination voltage applied to resistors 56. Since LVDS operates at a lower frequency than EDP mode and is thus slower, exact termination impedance to prevent signal reflection is not as critical compared with EDP mode. The characteristic impedance and the termination voltage applied to resistors 56 by the shared termination output 16 can be varied to maximize efficiency and reduce power consumption. In accordance to an embodiment of the present invention, different combinations of termination voltage and resistance values for resistors 56 can be applied to maximize overall efficiency of the display bridge. For example, applying the characteristic impedance of 50 ohms to resistors 56 increases current consumption compared with a greater characteristic impedance. However, noise and signal reflection are greatly reduced with a characteristic impedance of 50 ohms. Reducing the termination voltage from the shared termination output 16 and increasing the impedance of resistors 56 to 75 ohms reduces power consumption and increases overall efficiency, but noise and reflection can reduce the eye opening in the eye diagram. Adjusting the termination voltage to 1.8 v for example and increasing the impedance of resistors 56 to 100 ohms can further reduce power consumption. As long as the eye diagram of the output signal is sufficient for signal integrity, the termination voltage and impedance value for resistors 56 combination can be set for maximum efficiency. Accordingly, the LVDS mode may include the termination voltage changed according to LVDS mode voltage requirement.

While the present invention has been described with reference to certain preferred embodiments or methods, it is to be understood that the present invention is not limited to such specific embodiments or methods. Rather, it is the inventor's contention that the invention be understood and construed in its broadest meaning as reflected by the following claims. Thus, these claims are to be understood as incorporating not only the preferred methods described herein but all those other and further alterations and modifications as would be apparent to those of ordinary skilled in the art.

We claim:

1. A display bridge with support for multiple display interfaces, comprising:

a predriver configured to provide data input signals;

a shared output driver configured to receive the data input signals and provide output display signals compatible for driving MIPI-DSI, EDP, or LVDS displays;

a regulator and current source coupled to the shared output driver configured to regulate the shared output driver operating voltage and provide a current source for the shared output driver;

a shared termination output coupled to the shared output driver configured to provide termination resistance for the output display signals and termination voltage for the termination resistance, and a display serial interface switch coupled to the output driver configured to provide a signal path to ground.

2. The display bridge of claim 1, wherein the shared output driver is configured to receive the data input signals and provide output display signals compatible for driving a MIPI-DSI display and includes:

the predriver configured to provide a differential signal to the shared output driver;

the regulator and current source configured to set an operating voltage of approximately 400 mv for the shared output driver;

the shared termination configured to be in high impedance state; and the output driver configured to receive the differential signal and drives the output display signals based on the differential signal.

3. The display bridge of claim 2, wherein the output driver includes a first transistor configured to drive a positive output display signal and a second transistor configured to drive a negative output display signal.

4. The display bridge of claim 3, wherein the predriver is configured to level shift an operating range for the first transistor and the second transistor to achieve a Ron resistance of 50 ohms.

5. The display bridge of claim 1, wherein the display serial interface switch is a core transistor having low turn on impedance.

6. The display bridge of claim 1, wherein the shared output driver is configured to receive the data input signals and provide output display signals compatible for driving a EDP display and includes:

the predriver configured to provide a data in differential signal and a data in preemphasis signal;

the shared output driver configured to receive the data in differential signal and the data in preemphasis signal and provide positive output signals and negative output signals for driving an EDP display;

the regulator and current source configured to provide a first current source for the data in differential signal and a second current source for the data in preemphasis differential signal; and the shared termination output configured to set a termination voltage and a termination resistance for the positive output signals and the negative output signals.

7. The display bridge of claim 6, wherein the second current source for the data in preemphasis differential signal provides less current than the first current source for the data in differential signal.

8. The display bridge of claim 1, wherein the shared output driver is configured to receive the data input signals and provide output display signals compatible for driving a LVDS display and includes:

the predriver configured to provide a data in differential signal and a data in preemphasis signal;

the shared output driver configured to receive the data in differential signal and the data in preemphasis signal and provide positive output signals and negative output signals for driving a LVDS display;

the regulator and current source configured to provide a first current source for the data in differential signal and a second current source for the data in preemphasis differential signal; and the shared termination output configured to set a termination voltage and a termination resistance for the positive output signals and the negative output signals.

9. The display bridge of claim 8, wherein the shared termination output is adjustable to vary the termination voltage for the positive output signals.

10. The display bridge of claim 8, wherein the shared termination output is adjustable to vary the termination resistance for the negative output signals.

11. A display bridge with support for multiple display interfaces, comprising:

a predriver configured to provide data input signals;

a shared output driver configured to receive the data input signals and provide output display signals compatible for driving MIPI-DSI, EDP, or LVDS displays;

a regulator and current source coupled to the shared output driver configured to regulate the shared output driver operating voltage and provide a current source for the shared output driver; and a shared termination output coupled to the shared output driver configured to provide termination resistance for the output display signals and termination voltage for the termination resistance, wherein when driving a MIP-DSI display, the shared output driver is configured to receive the data input signals and provide output display signals compatible for driving the MIPI-DSI display and includes:

the predriver configured to provide a differential signal to the shared output driver;

the regulator and current source configured to set an operating voltage of approximately 400 mv for the shared output driver;

the shared termination configured to be in high impedance state;

the output driver configured to receive the differential signal and drives the output display signals based on the differential signal; and a display serial interface switch coupled to the output driver configured to provide a signal path to ground, wherein the output driver includes a first transistor configured to drive a positive output display signal and a second transistor configured to drive a negative output display signal, and wherein the predriver is configured to level shift an operating range for the first transistor and the second transistor to achieve a Ron resistance of 50 ohms.

12. The display bridge of claim 11, wherein the display serial interface switch is a core transistor having low turn on impedance.

13. The display bridge of claim 11, wherein the shared output driver is configured to receive the data input signals and provide output display signals compatible for driving a EDP display and includes:

the predriver configured to provide a data in differential signal and a data in preemphasis signal;

the shared output driver configured to receive the data in differential signal and the data in preemphasis signal and provide positive output signals and negative output signals for driving an EDP display;

the regulator and current source configured to provide a first current source for the data in differential signal and a second current source for the data in preemphasis differential signal; and the shared termination output configured to set a termination voltage and a termination resistance for the positive output signals and the negative output signals.

14. The display bridge of claim 13, wherein the second current source for the data in preemphasis differential signal provides less current than the first current source for the data in differential signal.

15. The display bridge of claim 11, wherein the shared output driver is configured to receive the data input signals and provide output display signals compatible for driving a LVDS display and includes:

the predriver configured to provide a data in differential signal and a data in preemphasis signal;

the shared output driver configured to receive the data in differential signal and the data in preemphasis signal and provide positive output signals and negative output signals for driving a LVDS display;

the regulator and current source configured to provide a first current source for the data in differential signal and a second current source for the data in preemphasis differential signal; and the shared termination output configured to set a termination voltage and a termination resistance for the positive output signals and the negative output signals.

16. The display bridge of claim 15, wherein the shared termination output is adjustable to vary the termination voltage for the positive output signals.

17. The display bridge of claim 15, wherein the shared termination output is adjustable to vary the termination resistance for the negative output signals.

18. A display bridge with support for multiple display interfaces, comprising:

a predriver configured to provide data input signals;

a shared output driver configured to receive the data input signals and provide output display signals compatible for driving MIPI-DSI, EDP, or LVDS displays;

a regulator and current source coupled to the shared output driver configured to regulate the shared output driver operating voltage and provide a current source for the shared output driver; and a shared termination output coupled to the shared output driver configured to provide termination resistance for the output display signals and termination voltage for the termination resistance, wherein when driving MIPI-DSI displays, the shared output driver is configured to receive the data input signals and provide output display signals compatible for driving a MIPI-DSI display and includes:

the predriver configured to provide a differential signal to the shared output driver;

the regulator and current source configured to set an operating voltage of approximately 400 mv for the shared output driver;

the shared termination configured to be in high impedance state;

the output driver configured to receive the differential signal and drives the output display signals based on the differential signal; and a display serial interface switch coupled to the output driver configured to provide a signal path to ground, wherein the output driver includes a first transistor configured to drive a positive output display signal and a second transistor configured to drive a negative output display signal, wherein the predriver is configured to level shift an operating range for the first transistor and the second transistor to achieve a Ron resistance of 50 ohms, and wherein the display serial interface switch is a core transistor having low turn on impedance, wherein when driving an EDP display, the shared output driver is configured to receive the data input signals and provide output display signals compatible for driving the EDP display and includes:

the predriver configured to provide a data in differential signal and a data in preemphasis signal;

the shared output driver configured to receive the data in differential signal and the data in preemphasis signal and provide positive output signals and negative output signals for driving an EDP display;

the regulator and current source configured to provide a first current source for the data in differential signal and a second current source for the data in preemphasis differential signal; and the shared termination output configured to set a termination voltage and a termination resistance for the positive output signals and the negative output signals, wherein the second current source for the data in preemphasis differential signal provides less current than the first current source for the data in differential signal, wherein when driving a LVDS display, the shared output driver is configured to receive the data input signals and provide output display signals compatible for driving the LVDS display and includes:

the predriver configured to provide a data in differential signal and a data in preemphasis signal;

the shared output driver configured to receive the data in differential signal and the data in preemphasis signal and provide positive output signals and negative output signals for driving a LVDS display;

the regulator and current source configured to provide a first current source for the data in differential signal and a second current source for the data in preemphasis differential signal; and the shared termination output configured to set a termination voltage and a termination resistance for the positive output signals and the negative output signals, wherein the shared termination output is adjustable to vary the termination voltage for the positive output signals, and wherein the shared termination output is adjustable to vary the termination resistance for the negative output signals.

* * * * *